US006910224B2

(12) United States Patent
Ikenaga et al.

(10) Patent No.: US 6,910,224 B2
(45) Date of Patent: Jun. 28, 2005

(54) ARTICLE OF CLOTHING WITH BUOYANT MATERIAL

(75) Inventors: Takashi Ikenaga, Osakasayama (JP); Shougo Ohara, Sakai (JP); Mariko Shiraishi, Izumi (JP)

(73) Assignee: Shimano Inc., Osaka (JP)

( * ) Notice: Subject to any disclaimer, the term of this patent is extended or adjusted under 35 U.S.C. 154(b) by 252 days.

(21) Appl. No.: 10/209,095

(22) Filed: Aug. 1, 2002

(65) Prior Publication Data

US 2003/0033659 A1 Feb. 20, 2003

(30) Foreign Application Priority Data

Aug. 15, 2001 (JP) ..... 2001-246756
Mar. 19, 2002 (JP) ..... 2002-077007

(51) Int. Cl.[7] ..... A41D 13/00; B63C 9/11

(52) U.S. Cl. ..... 2/102; 2/456; 441/115; 441/106

(58) Field of Search ..... 2/102, 94, 16, 2/18, 19, 20, 22, 24, 455–458, 2.15, 2.16, 459–468, 2.5, 92, 115, 67, 267, 268, 247–254, 255; 441/88, 102, 103, 104, 106–124, 126, 127, 125

(56) References Cited

U.S. PATENT DOCUMENTS 1,366,347 A * 1/1921 Bailey ..... 441/112
1,394,180 A * 10/1921 Lundin ..... 441/106
1,596,573 A * 8/1926 Beaulieu et al. ..... 441/102
1,901,906 A * 3/1933 Farmer et al. ..... 441/118
2,550,461 A * 4/1951 Fick ..... 2/16
2,563,241 A * 8/1951 Herbener ..... 450/55
2,629,118 A * 2/1953 Frieder et al. ..... 441/110
3,168,746 A * 2/1965 Smith ..... 2/24
3,189,919 A * 6/1965 Chase ..... 2/16
3,261,042 A * 7/1966 Baker ..... 441/112
3,725,956 A * 4/1973 Reisen ..... 2/171
3,727,249 A * 4/1973 Bonthelius ..... 441/118
4,523,914 A * 6/1985 Faulconer et al. ..... 441/108
4,723,322 A * 2/1988 Shelby ..... 2/24
4,799,908 A * 1/1989 Lucius ..... 441/115
4,831,666 A * 5/1989 Denman ..... 2/23
5,090,055 A * 2/1992 McElroy ..... 2/24
5,168,576 A * 12/1992 Krent et al. ..... 2/456
5,584,737 A * 12/1996 Luhtala ..... 2/2.5
5,603,648 A * 2/1997 Kea ..... 441/106
5,636,377 A * 6/1997 Wiener ..... 2/465
5,823,839 A * 10/1998 Khanamirian ..... 441/106
6,112,327 A * 9/2000 Shaffer ..... 2/67
6,216,272 B1 * 4/2001 Rosengren et al. ..... 2/102
6,235,661 B1 * 5/2001 Khanamirian ..... 442/223
6,421,833 B2 * 7/2002 Khanamirian et al. ..... 2/69
6,551,161 B2 * 4/2003 Chern et al. ..... 441/124
2004/0117895 A1 * 6/2004 Fortner ..... 2/267

* cited by examiner

*Primary Examiner*—A. Vanatta
(74) *Attorney, Agent, or Firm*—Shinjyu Global IP Counselors, LLP

(57) ABSTRACT

An article of clothing such as a vest incorporating buoyant material is configured to reduce pocket bulging when carried items that are placed in pockets and to allow the wearer to move freely. The article of clothing includes a main clothing unit having one or more pockets and one or more buoyant material sections coupled to the main clothing unit. One or more of the buoyant material sections has at least one concavity formed at a position on the outside and/or inside surfaces of the buoyant material sections at positions that correspond to one the pockets such and at least part of each the carrying spaces of the pockets are formed in one of the concavities. Preferably, buoyant material sections are generally plate-shaped. Preferably, the pockets are made of cloth and located at prescribed positions on the outside and/or the inside of the buoyant material sections.

32 Claims, 13 Drawing Sheets

ARTICLE OF CLOTHING WITH BUOYANT MATERIAL

BACKGROUND OF THE INVENTION

1. Field of the Invention

The present invention relates to an article of clothing that incorporates buoyant material. More particularly, the present invention relates to a vest that incorporates buoyant material. This type of vest is often referred to as a so-called "flotation vest".

2. Background Information

In the conventional art, this type of flotation vest includes plate-shaped sections of buoyant material comprising foamed plastic located at the left and right areas of the front portion and at the back portion thereof. Each buoyant material section is formed so as to conform to the corresponding shape of the front portion or back portion where it is located, and is housed in the main clothing unit that is made of cloth.

Furthermore, in a flotation vest that is used when fishing, the vest generally includes one or more small pockets used to hold various small items used for fishing, such as fishing line and a line cutter. These pockets can be located anywhere on the main clothing unit, but are usually located on the outer surface of the left and right areas of the front portion thereof. These pockets overlie the buoyant material such that small items are located between the outer surface of the buoyant material and the outer section of the pocket.

In view of the above, it will be apparent to those skilled in the art form this disclosure that there exists a need for an improved article of clothing having buoyant material. This invention addresses this need in the art as well as other needs, which will become apparent to those skilled in the art from this disclosure.

SUMMARY OF THE INVENTION

Incidentally, it has been discovered that in the above described vest that because the pockets on the outer surface of the front portion of the vest are located at positions that overlap the interior buoyant material when viewed from the front, the pockets protrude outward from the outer surface of the front portion. As a result, when carried items such as small fishing gear are housed in the pockets, the pockets bulge outward significantly.

Compared with an ordinary vest that does not incorporate buoyant material, a flotation vest is thicker in the front portion to the extent that the buoyant material is incorporated, and feels bulky when worn. As a result, in comparison with a normal vest, a flotation vest makes movement more difficult. In particular, flotation vests have the common problem that they hinder the subtle arm movements that are made when fishing. Furthermore, due to the thickness of the front portion of the flotation vest, it is difficult for the wearer to see where he or she is stepping.

In addition to the fact that it is more difficult for a person wearing a flotation vest while fishing to move than it is for a person wearing a normal vest, when the pockets on the outer surface of the front portion are caused to bulge out visibly toward the front by the small fishing items contained therein, the problems described above become even more significant.

The problems described above also apply to the pockets located on the outer surface of the front portion of the conventional flotation vest. In particular, when pockets are located on the outer surface of the back portion, fishing may be hindered in this case as well because it is easier for the wearer's back to come into contact with an obstacle due to the fact that the vest bulges outward toward the back when carried items are placed in the pockets. As described above, because the pockets are located outside the buoyant material in a flotation vest, when carried items such as small fishing gear are placed in the pockets, the pockets bulge outward substantially, and fishing may be hindered as a result.

Some vests, on the other hand, have the pockets on the inside rather than on the outside. For example, pockets can be placed on the inner surfaces of the front portion or the back portion of the vest. When carried items are placed in the pockets located on the inside of the buoyant material as described above, the pockets bulge inward. In other words, because the carried items contained in the pockets press against the body of the person wearing the vest, the vest no longer fits snugly against the body, and it becomes more difficult to move. In addition, the wearer often feels discomfort due to this the pressure.

These problems are not limited to flotation vests, and exist in all types of clothing that have cloth pockets located outside or inside buoyant material sections.

Furthermore, whether the pockets are made of cloth or of some other material, when the pockets bulge substantially, the movement of the person wearing the clothing is restricted by the increased thickness of the pockets.

Accordingly, in view of the foregoing problems with the conventional art, an object of the present invention is to provide an article of clothing incorporating buoyant material that enable the wearer to move easily and freely by reducing the amount of bulging of the pockets.

The present invention was created in order to resolve the problems described above. Basically, the foregoing problems can be overcome by providing an article of clothing comprising a main clothing unit and a buoyant material. The main clothing unit has at least one pocket located at a prescribed position. The buoyant material is coupled to the main clothing unit. The buoyant material has at least one concavity formed at a position that corresponding to the pocket such at least a part of a carrying space of the pocket is formed inside the concavity.

Using this construction, because at least a part of the carrying space of the pocket is formed inside the concavity, the amount of outward bulging of the pocket when small carried items are placed therein is reduced. Consequently, the risk that the pocket will come into contact with obstacles or the arms of the wearer is reduced, and the pocket is less likely to obstruct the walking or other movement of the wearer.

The article of clothing pertaining to the present invention preferably further comprises several plate-shaped buoyant material sections as well as pockets that are made of cloth and are located at prescribed positions on the outside and/or inside of the buoyant material sections, wherein concavities are formed at positions on the outside and/or inner surfaces of the buoyant material sections corresponding to the pockets, and at least a part of each carrying space of the pockets is formed inside one of the concavities.

Using this construction, because at least a part of the carrying space of the pockets is formed inside the concavities, when carried items are placed in the pockets, the amount of inward bulging thereof, i.e., the amount of bulging toward the wearer's body, is reduced. Consequently, the clothing fits more snugly against the wearer's body, making it easier for the wearer to move and reducing the wearer's discomfort.

In a preferred embodiment, the article of clothing pertaining to the present invention is a flotation vest with a plurality of pockets and buoyant material sections that have concavities corresponding to the pockets.

Using this construction, because the front pockets do not obstruct the wearer's arms, the fine arm movements necessary for fishing or the like can be performed smoothly. In particular, because the amount of bulging of the front pockets is reduced, the wearer's line of sight to whatever is underfoot is less obstructed.

In accordance with another aspect of the present invention, the article of clothing pertaining to the present invention preferably further comprises plate-shaped buoyant material sections as well as pockets that are made of cloth and are located at prescribed positions on the inside or outside of the buoyant material sections, wherein through holes are formed at positions on the inner or outer surface of the buoyant material sections corresponding to the pockets, and at least a part of the carrying space of the pockets is formed inside the through holes.

It is particularly preferred that the outer wall of each pocket be formed from a plate-shaped member having a shape-retaining property. If such a construction is used, an attractive appearance can be obtained regardless of whether items are being carried in the pocket. Furthermore, in addition to the fact that the minimal amount of bulging of the pocket means that it is unlikely that external force will be applied to the outer wall thereof, even where external pressure is applied, because the outer wall has a shape-retaining property, the items carried inside are protected from the external force. Therefore, because buoyant material is located behind the pocket, a concavity is formed in this buoyant material and is used as carrying space, and the outer wall of the pocket has a shape-retaining property, the carried items can be effectively protected.

It is furthermore preferred that the outer wall of each pocket be formed such that the outer surface thereof protrudes outward. In this case, the pocket is not as vulnerable to inward deformation as a pocket with a flat outer surface, and its strength against external force can be easily ensured. It is particularly preferred that the pocket outer wall have a dome configuration, which increases its strength still further.

In addition, it is preferred that the plate-shaped member comprise a plate-shaped foam piece that is laminated with a covering sheet on at least the outer surface thereof. The use of a plate-shaped foam piece enables the carried items inside the pocket to be effectively protected through a buffer effect. Furthermore, the plate-shaped foam piece itself is also protected by the covering sheet.

It is furthermore preferred that the pocket outer wall be formed, by hot press shaping the plate-shaped foam piece, such that the outer surface protrudes outward, which enables manufacturing to be carried out easily even where the pocket configuration is complex.

It is particularly preferred that the covering sheet comprise waterproof film. Not only does waterproofing reduce the adherence of dirt or other foreign matter, it also makes such dirt or other foreign matter easy to wipe off. Because the outer wall has a shape-retaining property, when dirt or other foreign matter is being wiped off, the wiping operation can be easily performed. In particular, because dirt or other foreign matter adheres easily to the outer surface where the outer wall is formed so as to protrude outward, the use of waterproof film is highly effective.

It is also preferred that the outer wall of the pocket have the ability to open and close using the bottom edge thereof as a hinge-like fulcrum. Using this construction, the pocket can be opened widely, making it easy to place items inside the pocket and remove them therefrom. Furthermore, because the outer wall of the pocket has a shape-retaining property, the pocket can be opened and closed easily.

It is particularly preferred that the clothing incorporating buoyant material pertaining to the present invention include holding means that holds the outer wall of the pocket open at a prescribed angle so that the outer wall does not flop down. This construction is effective in preventing the items carried inside the pocket from falling out, and an attractive appearance can be maintained because the outer wall has a shape-retaining property.

It is moreover preferred that the holding means hold the pocket outer wall such that the outer wall has an essentially horizontal orientation. In this case, because the outer wall has a shape-retaining property, it can be used as a place for holding small items or as a work platform. In addition, if the outer wall is formed such that the outer surface thereof protrudes outward, the inner surface will accordingly have a concave configuration, and small items that are held therein can consequently be prevented from falling out.

It is also preferred that a small pocket be formed on the inner surface of the outer wall of the pocket by sewing a piece of fabric onto the inner surface of the outer wall. Forming a small pocket in this fashion makes the separate carrying of small items more convenient, and carrying small items in a pocket on the inner surface of the outer wall makes them easier to extract.

In particular, it is preferred that a concavity for carrying items be formed on the inner surface of the outer wall of the pocket, and that this small pocket be located at the position at which this concavity is formed. By forming a carrying concavity on the inner surface of the pocket outer wall, carried items can be carried in a more stable fashion than where the inner surface is flat.

It is furthermore preferred that a plurality of carrying concavities be formed, and that these plurality of carrying concavities comprise independent small pockets, which allows a different type of carried item to be carried in each carrying concavity through a partition capability.

Moreover, it is preferred that the piece of fabric comprise a piece of stretch fabric such that the carried items carried in the small pocket are held by being pressed against the inner surface of the outer wall of the pocket due to the elasticity of the stretch fabric, thereby enabling the carried items to be held in a reliable manner. In this case, because the outer wall has a shape-retaining property, a good external appearance can be maintained even where pressure is exerted by the piece of stretch fabric on the inner surface of the pocket outer wall.

It is additionally preferred that the concave wall surfaces of the buoyant material comprise the inner walls of the pocket, thereby allowing a pocket lining to be eliminated.

It is also preferred that the pocket be freely attachable to and detachable from the clothing. In the case of clothing incorporating buoyant material, once the clothing is put on, the presence of the buoyant material makes it more difficult for the wearer to place items into and remove items from the pockets than in the case of ordinary clothing, but because the pockets can be used while the clothing is being worn, such as while the pockets are detached from the clothing, carried items can be easily placed into and removed from the pockets. Moreover, the pockets can be kept attached to the clothing until the wearer reaches the intended location, such as a fishing spot, for example, which reduces the amount of bulging of the pockets, thereby reducing the bulkiness of the clothing accordingly.

It is particularly preferred that the fixing means to fix each pocket to the clothing be located inside the concavity in the buoyant material, such that the fixing means does not constitute a hindrance when the pocket is detached.

It is furthermore preferred that the fixing means constitute a hook and loop fastener, and that either the hook part or the loop part of the hook and loop fastener be located on the pocket while the other is located inside the concavity. If a hook and loop fastener is used, not only is it easier to attach and detach the pocket, but because the hook and loop fastener is located inside the concavity, the pocket can be automatically fixed to the clothing by placing it inside the concavity.

It is also preferred that the loop part of the hook and loop fastener be located on the pocket, while the hook part of the hook and loop fastener is located on the clothing. By locating the loop part on the pocket, which can become dirty from being repeatedly attached to and detached from the clothing, and locating the hook part in the concavity, the adherence of dirt or other foreign matter to the hook part can be effectively minimized.

It is particularly preferred that the hook part be located at the bottom of the concavity. Because the direction in which the hook part engages with the loop part essentially matches the direction of pocket placement inside the concavity, the pocket can be reliably fixed via the placement operation, and because the hook part is located in the bottom of the concavity, the adherence of dirt or other foreign matter can be effectively prevented.

These and other objects, features, aspects and advantages of the present invention will become apparent to those skilled in the art from the following detailed description, which, taken in conjunction with the annexed drawings, disclose preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
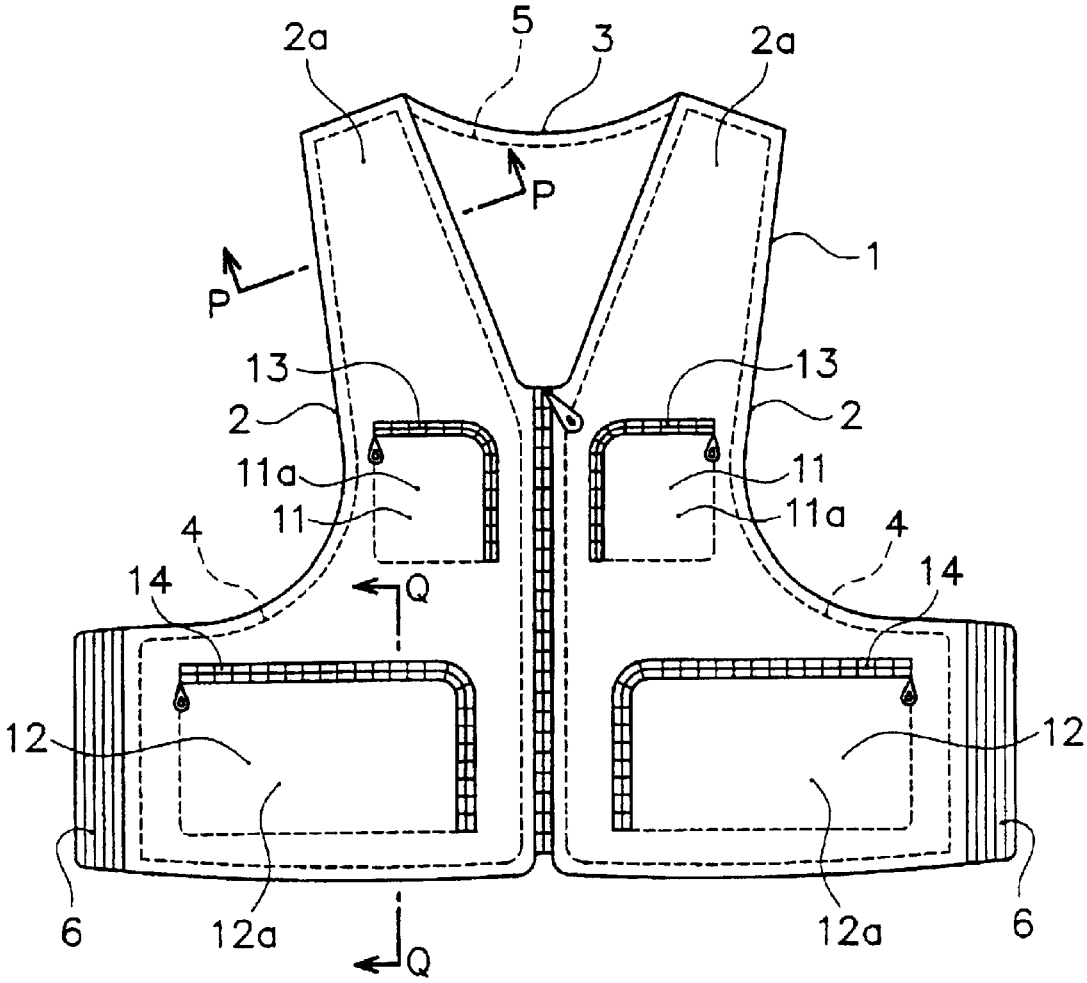
FIG. 1 is a front elevational view of a vest incorporating buoyant material in accordance with one embodiment of the present invention.

Referring initially to FIG. 1, an article of clothing incorporating buoyant material is illustrated in accordance with a first embodiment of the present invention. In the illustrated embodiment, the article of clothing of the present invention is a flotation vest that is a fishing garment. The article of clothing or vest basically includes a main clothing unit 1 (left and right front portions 2 and a back portion 3) and a plurality of plate-shaped buoyant material sections 4 and 5. The back portion 3 is connected to the front portions 2 via a pair of expandable waist adjustment members 6 located at the left and right side areas. The left and right front portions 2 and the back portion 3 are preferably constructed of flexible cloth materials that generally provide very little buoyancy to the vest. The plate-shaped buoyant material sections 4 and 5 are located on the front portions 2 and the back portion 3, respectively. The plate-shaped buoyant material sections 4 and 5 will be described with reference to FIGS. 1–6.

Figure 2:
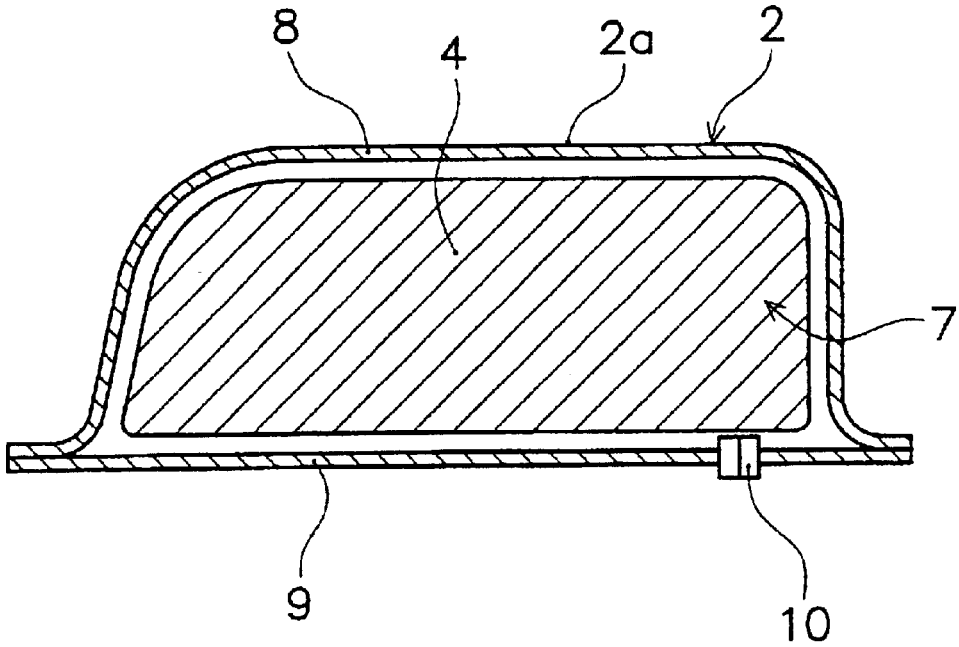
FIG. 2 is a cross sectional view of the vest shown in FIG. 1 as seen along section line P—P of FIG. 1.

The buoyant material sections 4 and 5 are housed in the main clothing unit 1 that is made of cloth. In other words, as best shown in FIG. 2, a buoyant material housing area 7 is formed in each of the front sections 2 and the back section 3 of the main clothing unit 1. In particular, each of the front sections 2 and the back section 3 of the main clothing unit 1 includes a front fabric piece 8 and an inner liner 9 that are sewn together. Thus, three buoyant material housing areas 7 are formed in the main clothing unit 1 between the front fabric piece 8 and the lining 9 by sewing together the edges of the front fabric piece 8 and the liner 9. In this embodiment, a slide fastener 10 is formed in the liners 9 of each of the buoyant material housing areas 7 to form an opening that can be opened and closed using. In this way, each of the buoyant material sections 4 is removably housed in a corresponding one of the buoyant material housing areas 7.

Figure 3:
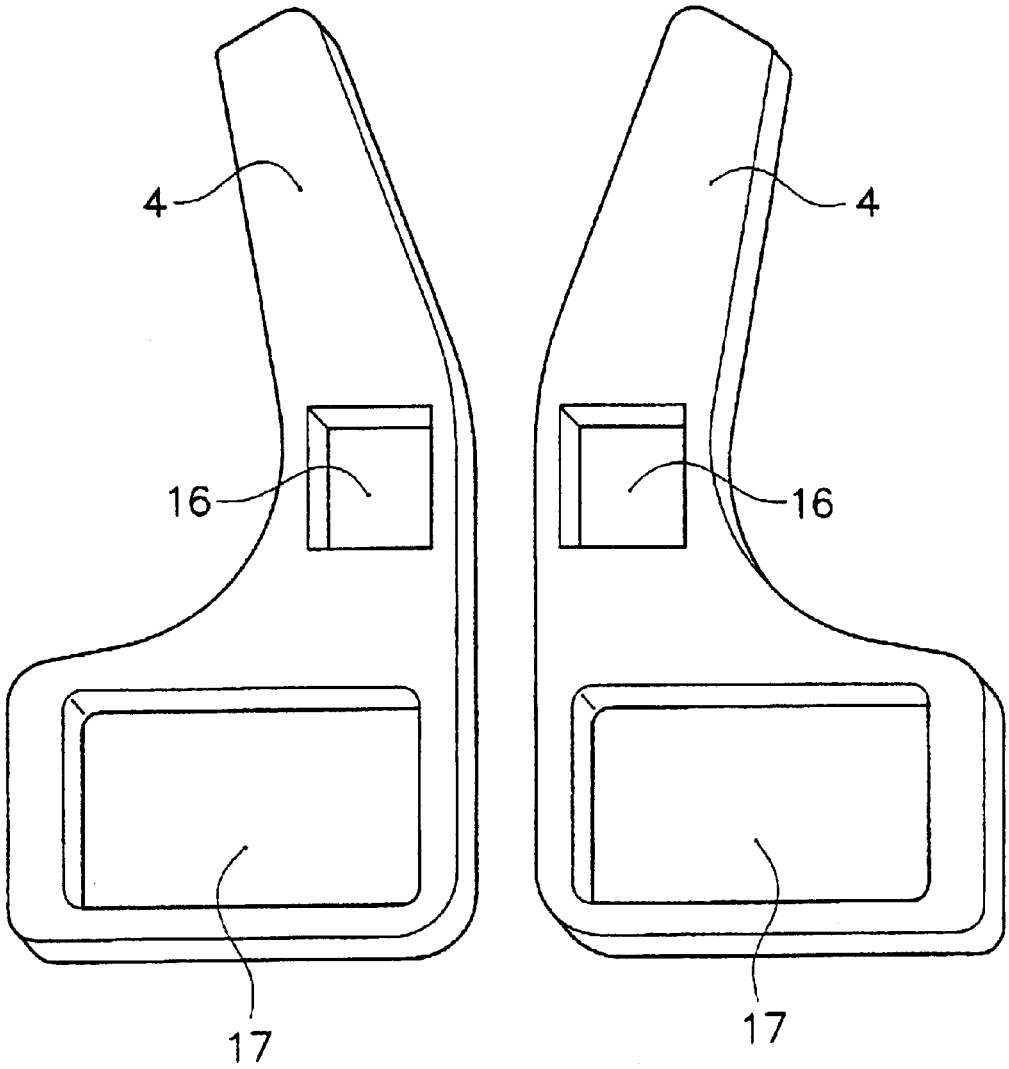
FIG. 3 is a front perspective view of the buoyant material sections used in the vest incorporating buoyant material shown in FIG. 1.

Furthermore, each of the buoyant material section 4 and 5 is formed in accordance with the size of the corresponding front portion 2, etc. For example, the buoyant material sections 4 located in the buoyant material housing areas 7 of the front portions 2 are formed in shapes that generally match the overall shape of the corresponding front portions 2, as shown in FIG. 3. Thus, the buoyant material housing area 7 formed in each front portion 2 of the main clothing unit 1 preferably takes up essentially the entire area of each front portion 2. The same arrangement is true of the back portion 3 as well.

At the same time, with reference to FIG. 1, the outside pockets 11 and 12 are formed at upper and lower positions on the outer surface 2*a* of each front portion 2 of the main clothing unit 1. In other words, the pockets 11 and 12 are located such that they overlap prescribed positions on the outside of the buoyant material sections 4. Each of the pockets 11 and 12 is formed in a generally square configuration as seen from the front. Each of the pockets 11 and 12 has a generally L-shaped opening that extends from the pocket's top edge to the bottom of the pocket's side located in the center of the vest. Slide fasteners or zippers 13 and 14 are located in the openings of the pockets 11 and 12, respectively, thereby allowing the pockets 11 and 12 to open and close freely.

Figure 4:
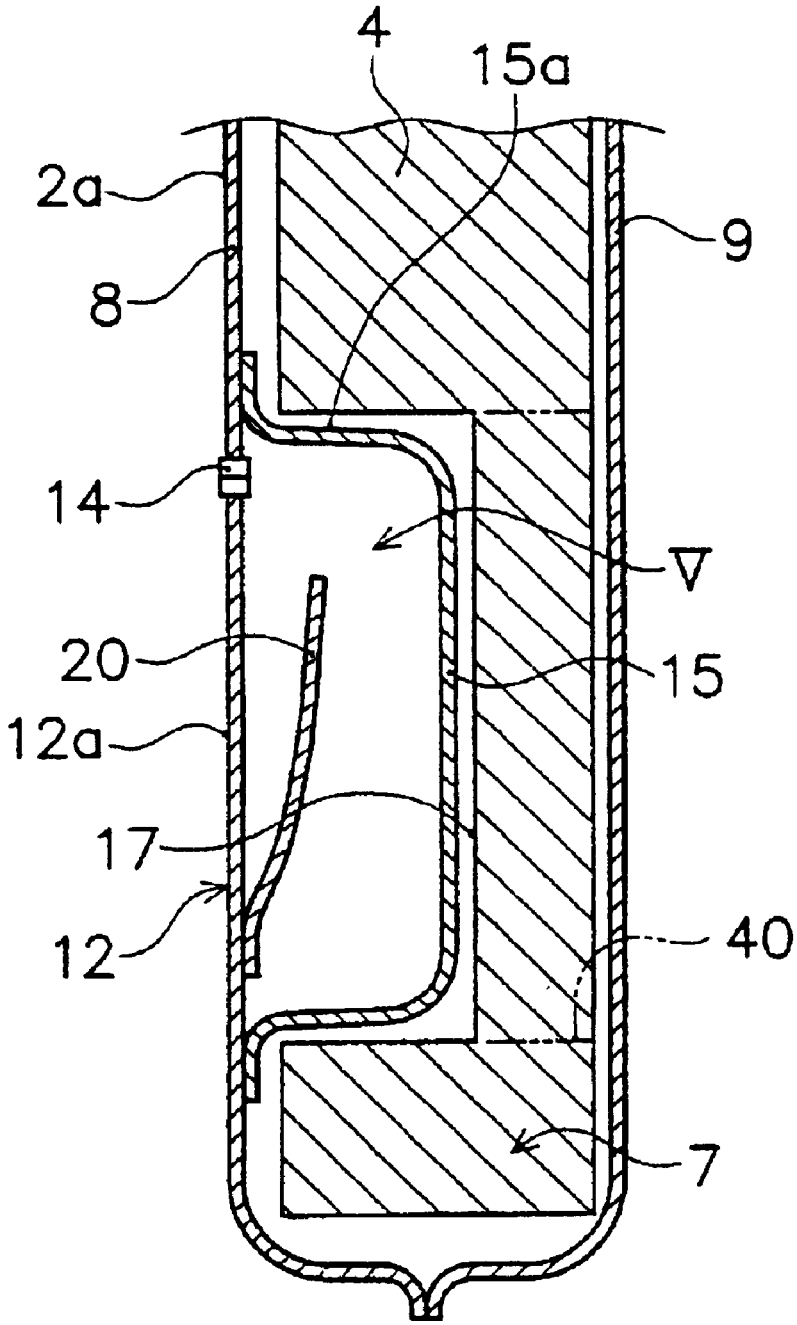
FIG. 4 is a partial cross sectional view of the vest shown in FIG. 1 as seen along section line Q—Q of FIG. 1.
Figure 5:
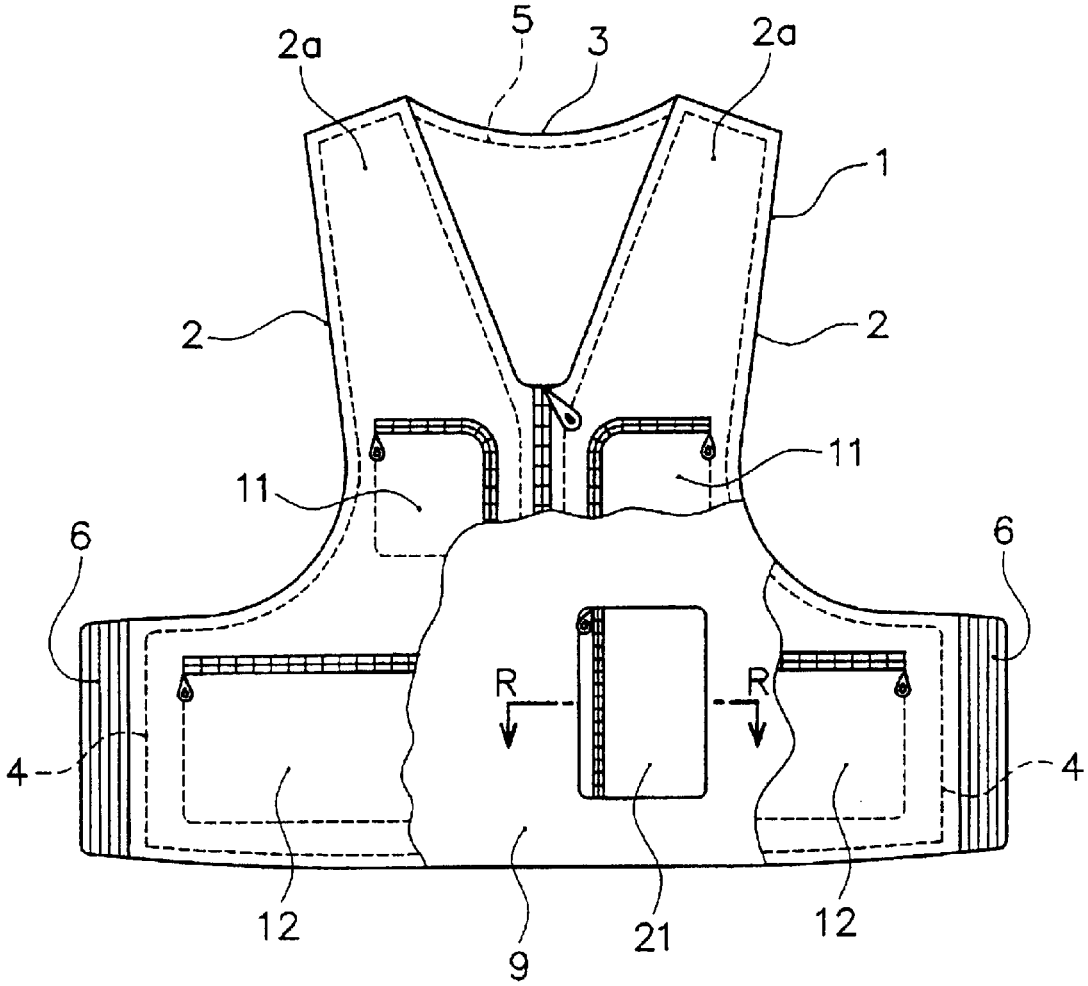
FIG. 5 is a front elevational view of the vest shown in FIG. 1 with a portion cutaway to illustrate an inside pocket.
Figure 6:
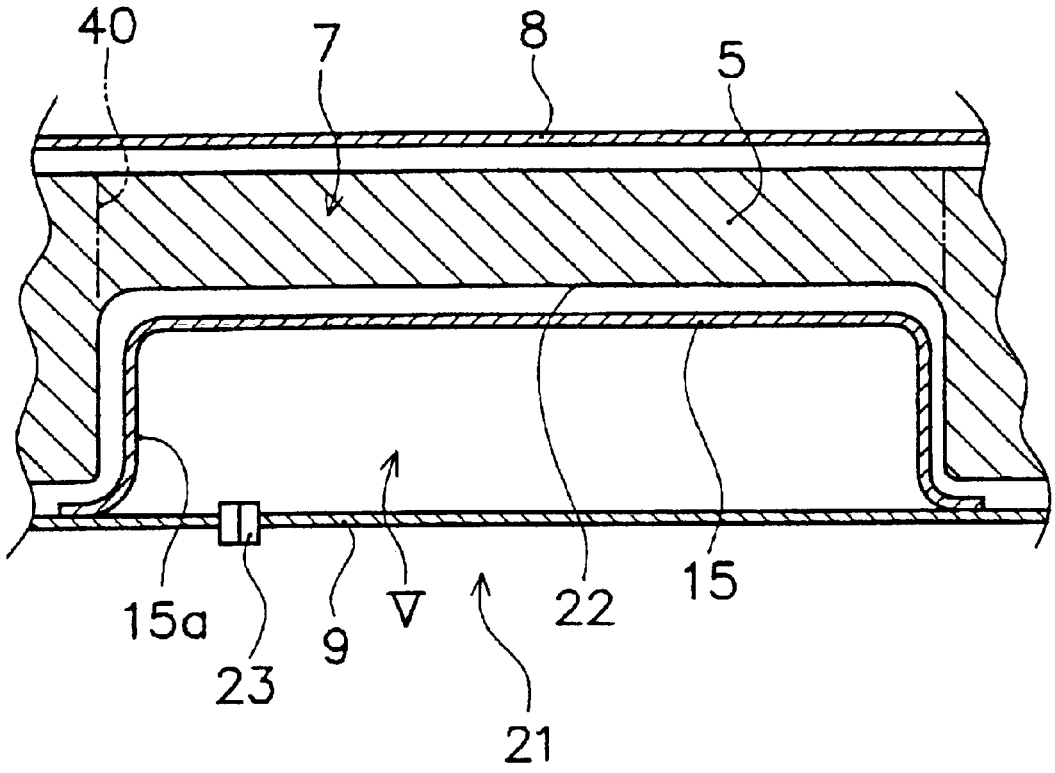
FIG. 6 is a partial cross sectional view of the vest shown in FIG. 1 as seen along section line R—R of FIG. 5.

Each lower pocket 12 is formed such that it does not bulge out from the outer surface 2*a* of the front portion 2, as shown in FIG. 4, because the outer wall 12*a* of each pocket 12 is formed such that it is essentially flush with the outer surface 2*a* of the front portion 2. In other words, the front fabric pieces 8 of the front portions 2 form the outer walls 12*a* of the pockets 12. Furthermore, a pocket lining 15 is sewn to the inner surface of each of the front fabric pieces 8, such that a carrying space V is formed between each of the front fabric pieces 8 of the front portions 2 and the pocket linings 15. The same construction is used for each upper pocket 11, such that the outer walls 11*a* are essentially flush with the outer surfaces 2*a* of the front portions 2.

At the same time, several concavities 16 and 17 are formed in the buoyant material sections 4 of the front portions 2 at positions corresponding to the pockets 11 and 12, respectively, as shown in FIG. 3. Each of the concavities 16 and 17 has generally the same area as the corresponding pocket 11 or 12, and its configuration is essentially square as seen from the front, so as to match the configuration of the corresponding pocket 11 or 12. The depth of each concavity 16 and 17 is essentially identical. In addition, while the concavities 16 and 17 are located as described above, in order to ensure that the flotation vest has the same specified buoyancy as the conventional flotation vest, the total volume of each buoyant material section 4 is set to be identical to such volume in the conventional flotation vest, and consequently each section is somewhat thicker at the back side.

As shown in FIG. 4, a gusset 15*a* having a prescribed width is preferably attached to each pocket lining 15 described above, such that the pocket linings 15 extend into each of the concavities 16 and 17 formed in the buoyant material sections 4. Therefore, as a result of the concavities 16 and 17 formed in each buoyant material section 4, an indentation in each pocket lining 15 from the essentially flat front fabric piece 8 of the front portion 2 is formed to match the configuration of each concavity 16 and 17 formed in each buoyant material section 4. Thus, a carrying space V in each pocket 11 and 12 is formed in essentially the entire area of each concavity 16 and 17 in each buoyant material section 4.

Figure 14:
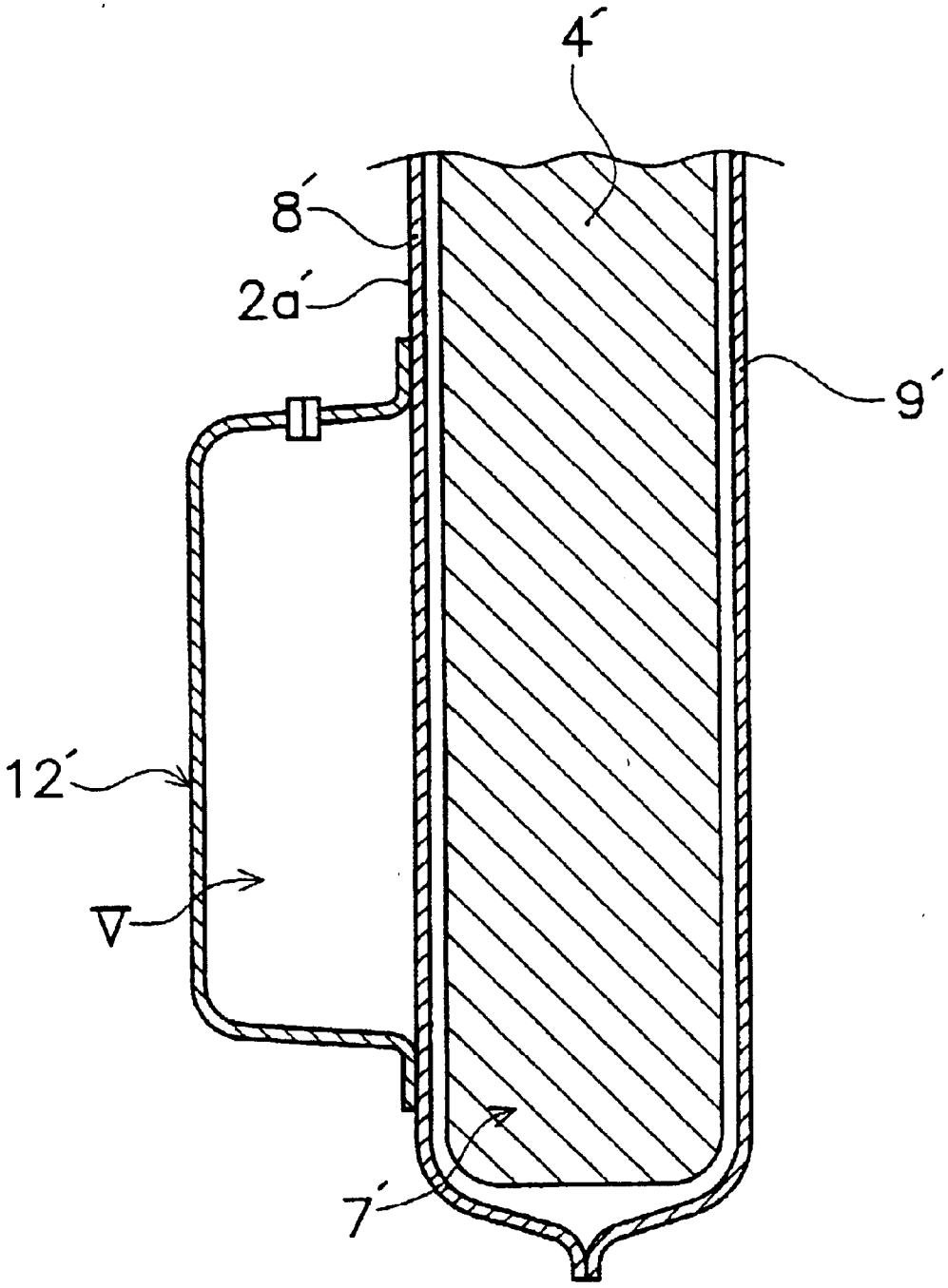
Fig. 14 (PRIOR ART)
FIG. 14 is a partial cross-sectional view, corresponding to FIG. 4, of a conventional vest that incorporates buoyant material.

In other words, in the conventional prior art vest shown in FIG. 14, the pocket 12' is formed such that it protrudes outward from the outer surface 2*a'* of the front portion 2', and as a result, the carrying space V' of the pocket 12' is also formed at a position outside the outer surface 2*a'* of the front portion 2'. By contrast, in this embodiment, because the carrying spaces V of the pockets 12 are formed at a position that are recessed from the outer surfaces 2*a* of the front portions 2, the outer surfaces 2*a* of the front portions 2 are essentially flat across the entire area of the pockets. Consequently, when the flotation vest of this embodiment is worn while fishing, the amount of bulging from the chest and stomach areas is reduced, and it is easier for the wearer to move in comparison with the flotation vest of the conventional art.

When fishing, because success is closely related to the speed with which one can perform operations such as changing the lure or removing the line with a line cutter, it is common to carry as many small items of fishing gear as possible in the pockets 11 and 12 formed on the outer surfaces 2*a* of the front portions 2, in order to enable these items to be retrieved and used as necessary.

With regard to the vest of this embodiment, because the carrying spaces V for the pockets 11 and 12 are formed in the concavities 16 and 17, the necessary carrying capacities of the pockets 11 and 12 are ensured without forming the pockets 11 and 12 in such a manner that they bulge outward when full, enabling a large number of small items of fishing gear to be carried therein. Furthermore, because outward bulging of the pockets can be prevented, arm movements are easy to make, thereby allowing operations such as switching of the lure to be carried out easily, and the wearer's ability to see where he or she is stepping is not obscured by the bulging of the pockets 11 and 12. Moreover, the pockets 11 and 12 are prevented from coming into contact with obstacles when the wearer is moving.

As shown in FIG. 4, the front portion 2 of the main clothing unit 1 includes at least one small pocket 20 that opens upward. The small pocket 20 is located on the inner surface of the front fabric piece 8 that forms the outer wall 12*a* of the lower pocket 12. It is also possible to locate this small pocket 20 on the pocket lining 15 that forms an inner wall of the pocket 12. However, because the carrying space V of the pocket 12 is recessed inward, it is preferred that the small pocket 20 be located not on the pocket lining 15, but rather on the inner surface of the outer wall 12*a* of the pocket 12, which makes it easier to retrieve carried items that have been placed in the small pocket 20.

Furthermore, where an inside pocket is located on the inner surface of the front portion 2, i.e., on the lining 9 of the front portion 2, it is preferred that a concavity be formed on the inner surface of the buoyant material section 4 as shown in FIG. 3 at a position corresponding to this inside pocket, and that the carrying space of this inside pocket be formed in this concavity. However, it is preferred that the positions of the inside pockets and outside pockets be offset from each other, such that they are not formed at the same position.

The same principle applies with regard to pockets formed on the back portion 3. For example, when an inside pocket 21 is located on the lining 9 of the back portion 3, a concavity 22 is formed at a position on the inner surface of the buoyant material section 5 that corresponds to the inside pocket 21. Like the outside pockets 11 and 12, the pocket 21 has a construction in which a slide fastener 23 is located at the vertical opening of the pocket 21, a pocket lining 15 to which a gusset 15*a* is attached is placed in the concavity 22, and the carrying space V is formed inside the concavity 22. By forming a concavity 22 at a position corresponding to the inside pocket 21 in this fashion, the inside pocket 21 does not bulge in the direction of the wearer's body even where it contains carried items, unlike the pocket of the conventional art, and as a result, the pocket 21 is unlikely to press against the wearer's body and the fit of the vest against the body becomes snug while still allowing freedom of movement. Furthermore, discomfort cause by pressure of the pocket 21 against the body is also eliminated.

In order to prevent the flotation vest from slipping off the wearer over the head, a strap that connects the front portions 2 and the back portion 3 by running from front to back under the crotch area is normally used when the flotation vest is worn. Where this strap is not used, it is often placed inside the inside pocket 21 located on the back portion 3. In this case, because the carrying space V of this inside pocket 21 is formed in the concavity 22, the inside pocket 21 also does not bulge toward the wearer's body.

Moreover, in this embodiment, the gussets 15*a* are attached to the pocket linings 15 such that the pocket linings 15 extend in the concavities 16, 17 and 22. It is preferred that the cloth comprising the pockets 11, 12 and 21 be sewn such that extra margin exists to allow the part of the cloth that faces the concavities 16, 17 and 22, respectively, to be placed inside the concavities 16, 17 and 22. It is also acceptable if a shape-retaining member is affixed to each pocket lining 15 to allow the pocket linings 15 to be reliably placed inside the concavities 16, 17 and 22. It is furthermore acceptable if a piece of stretch fabric is used for the pocket linings 15, for example, such that the pocket linings 15 can extend into the space in the concavities 16, 17 and 22 when carried items reside in the pockets.

Furthermore, it is acceptable if only a part of the carrying space V is formed in the concavity, rather than essentially all of it. In either case, the amount of bulging in either the outward or inward direction can be reduced relative to the conventional art. In addition, various types of fabric can be used as the cloth from which the pocket is made, and a stretch fabric can be used. This stretch fabric can comprise, for example, a sheet of chloroprene rubber used to make wetsuits or the like, with a layer of jersey affixed thereto.

Additional Embodiments

Referring now to FIGS. 7–13, additional embodiments of an article of clothing such as a vest will now be explained in accordance with the present. In view of the similarity between the first embodiment and these additional embodiments, the parts of the additional embodiments that correspond to the parts of the first embodiment will be given the same reference numerals as the parts of the first embodiment. Moreover, the descriptions of the parts of the additional embodiments that correspond to the parts of the first embodiment may be omitted for the sake of brevity.

Various types of pocket constructions can be used, as shown in FIGS. 7–13. For example, the pocket outer wall can comprise a plate-shaped member having a shape-retaining property, as shown in the second embodiment of FIGS. 7–10.

Figure 7:
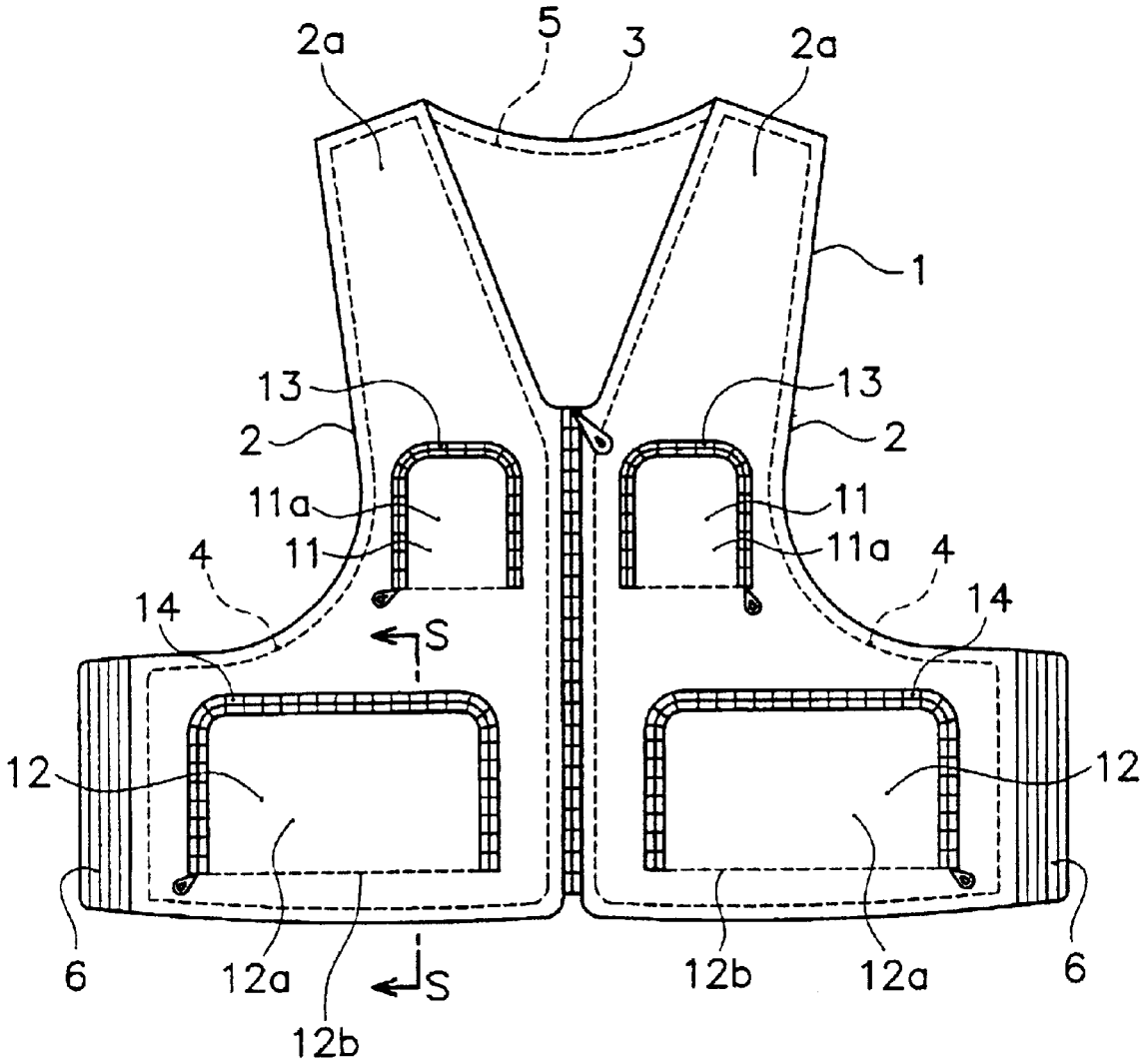
FIG. 7 front elevational view of a vest incorporating buoyant material in accordance with another embodiment of the present invention.

All of the upper and lower pockets 11 and 12 on the flotation vest shown in FIG. 7 include an outer wall 11*a* or 12*a* comprising a plate-shaped member constructed of a material having a self supporting or shape-retaining property. However, only the lower pockets 12 will be described below, but the description of the lower pockets 12 applies equally to the upper pockets 11 as well.

Figure 8:
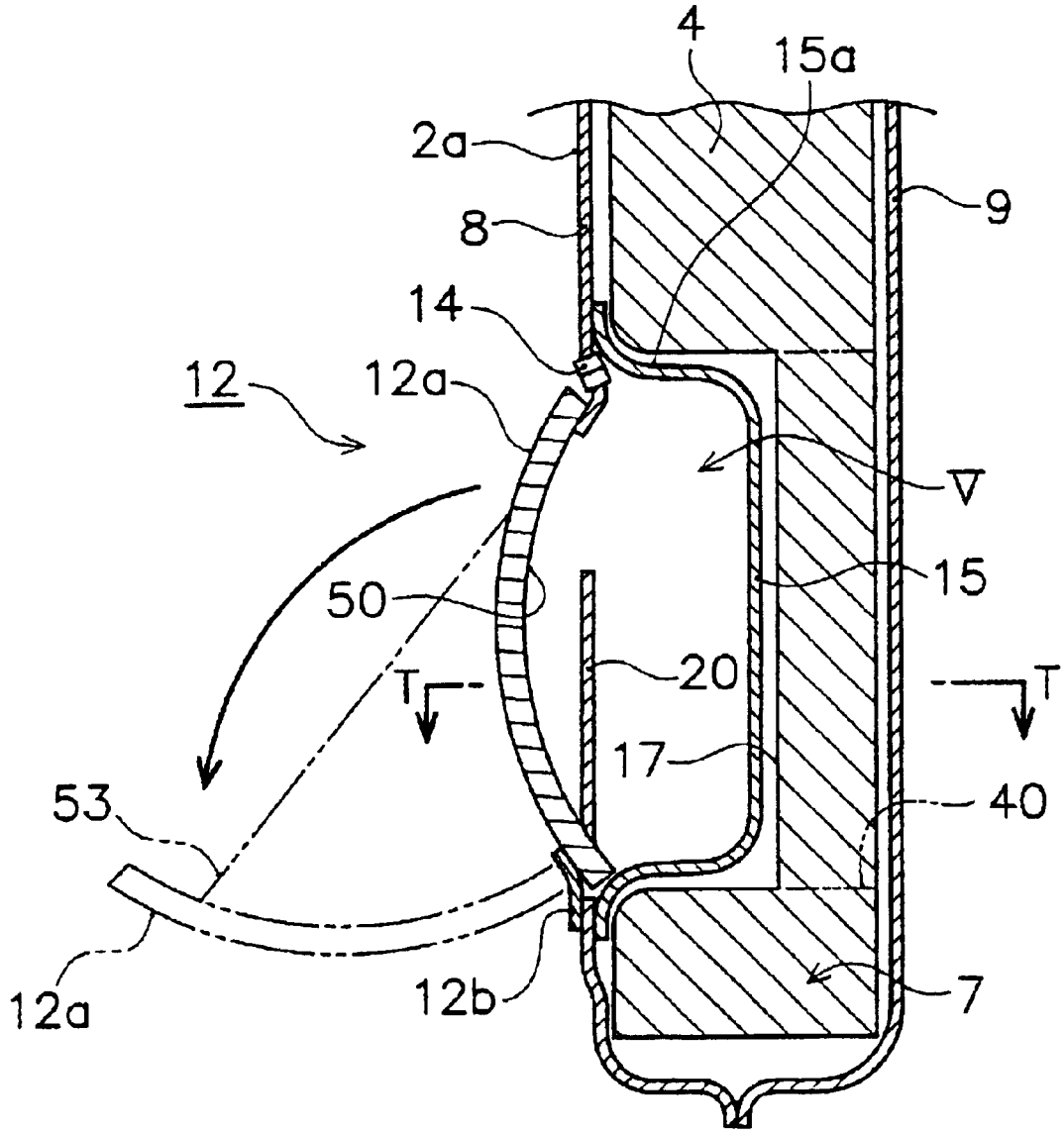
FIG. 8 is a partial cross sectional view of the vest shown in FIG. 7 as seen along section line S—S of FIG. 7.

The outer walls 12*a* of the pockets 12 are curved in a dome-like configuration such that the outer surface as seen from a longitudinal cross-sectional view (the surface opposite the buoyant material section 4) protrudes outward, as shown in FIG. 8. Furthermore, although the transverse cross-sections of the outer walls 12*a* have generally waveform-like configurations, as shown in FIG. 9, the outer surface as a whole is curved in a dome-like configuration such that it protrudes outward of the front portions 2.

Figure 9:
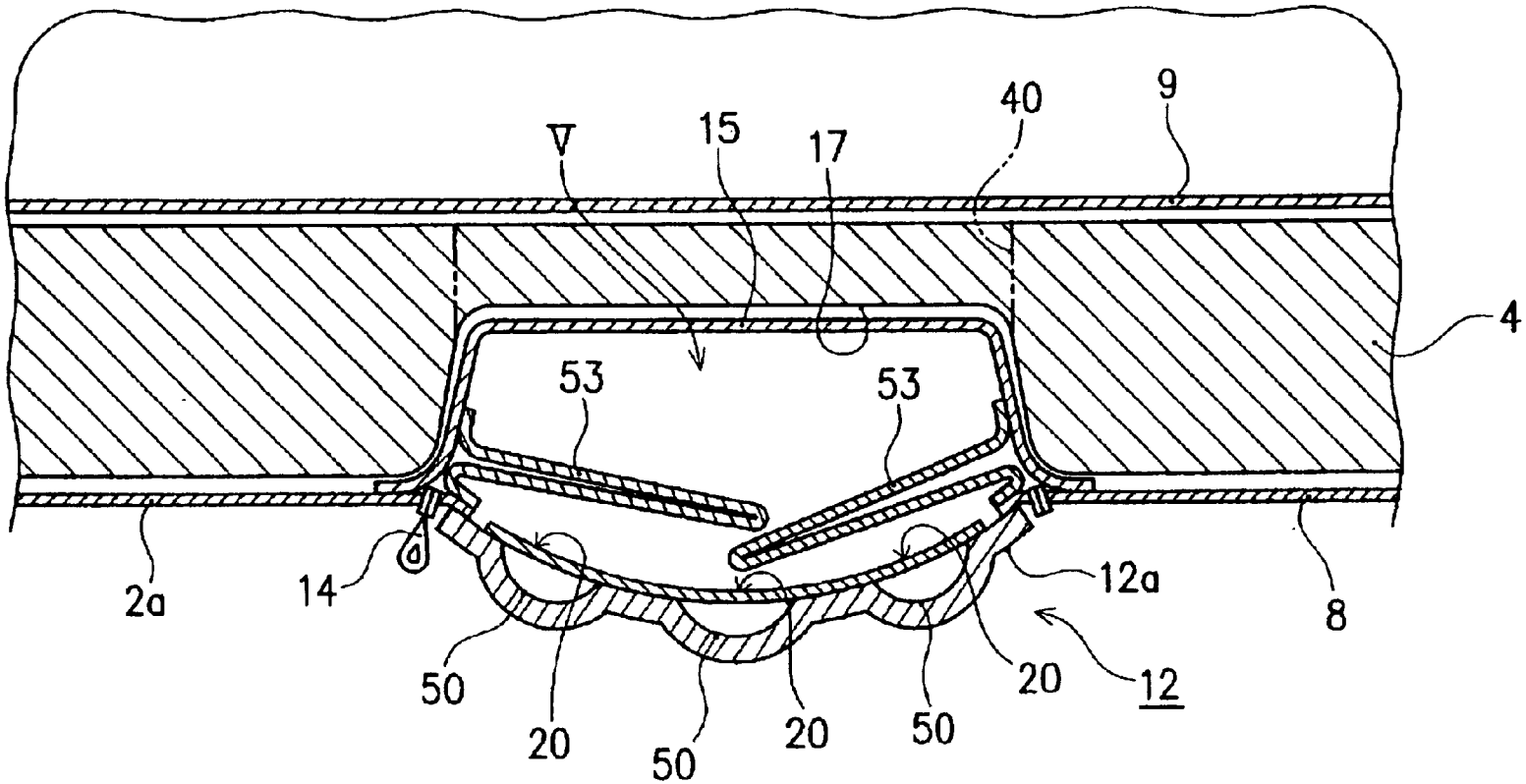
FIG. 9 is a partial cross sectional view of the vest shown in FIG. 7 as seen along section line T—T of FIG. 8.
Figure 10:
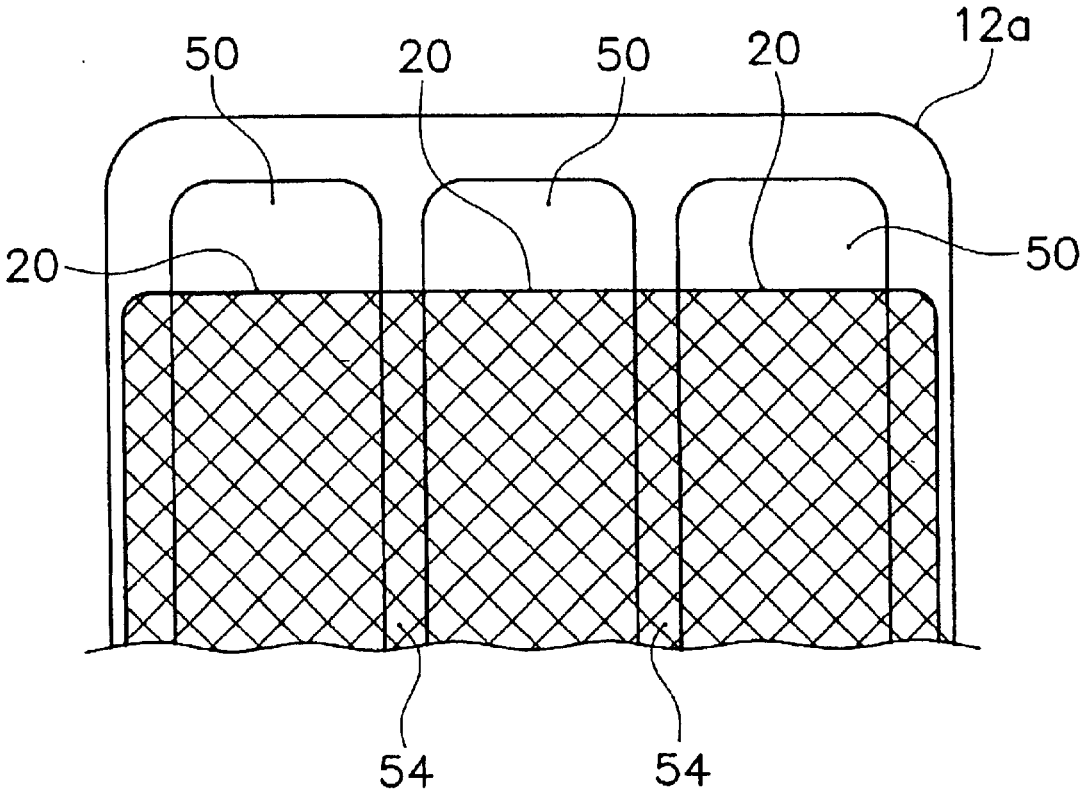
FIG. 10 is a partial inside elevational view of an outer wall of a pocket of the vest shown in FIG. 7 as seen from the inner surface.

As shown in FIGS. 9 and 10, the outer walls 12*a* are the shaped to form a plurality of carrying concavities 50 along their inner surfaces. The carry concavities 50 extend vertically parallel to each other along the inner surfaces of the outer walls 12*a* with a prescribed gap between each of the carry concavities 50, as shown in FIG. 9. Because the outer walls 12*a* of the pockets 12 comprise plate-shaped members as described above, the formation of these carrying concavities 50 in the inner surfaces thereof creates corresponding protrusions in the outer surfaces of the outer walls 12*a*. The formation of the carrying concavities 50 in the inner surfaces of the outer walls 12*a* in this fashion gives the transverse cross-sections of the outer walls 12*a* waveform-like configurations, as described above. In addition, the outer walls 12*a* are formed with essentially uniform thicknesses.

Furthermore, in the flotation vest of this embodiment as well, several small pockets 20 that open at the top are formed on the inner surfaces of the outer walls 12*a* of each of the pockets 12. These small pockets 20 are formed by sewing a piece or pieces of fabric onto the inner surfaces of the outer walls 12*a*. These small pockets 20 are formed at the positions at which the carrying concavities 50 are formed. In particular, the piece or pieces of fabric are sewn onto the border areas 54 between adjacent pairs of the carrying concavities 50. Thus, the carrying concavities 50 form a plurality of independent small pockets 20. In other words, a different type of small item (carried item) can be carried in each carrying concavity 50. A single piece of fabric can be used to cover all of the carrying concavities 50, or a separate piece of fabric can be used for each carrying concavity 50.

Various types of cloth can be used for this fabric of the small pockets 20. In this embodiment, a rubber net is used as the stretch fabric. However, the cloth is not limited to a net-type fabric. By using stretch fabric in this fashion, small items (carried items such as scissors) carried in the small pockets 20, can be held pressed against the inner surface of the outer wall 12*a* due to the elasticity of the stretch fabric. Therefore, the small item can be held in a stable fashion. Furthermore, while a small item is held in contact with one of the inner surfaces of the outer walls 12*a*, damage to the small item can be effectively prevented because external impact can be minimized if the outer wall 12*a* is made of a plate-shaped foam piece 52 as described below.

Furthermore, because the carrying concavities 50 are formed on the inner surfaces of the outer walls 12*a*, small items are held in a more stable fashion than is achieved when the inner surfaces are flat. In addition, because several carrying concavities 50 are formed independently of each other, it is convenient to carry small items separately. Small items can be held in an even more reliable fashion if the carrying concavities 50 are formed in configurations that correspond to the configurations of the small items being carried.

Figure 11:
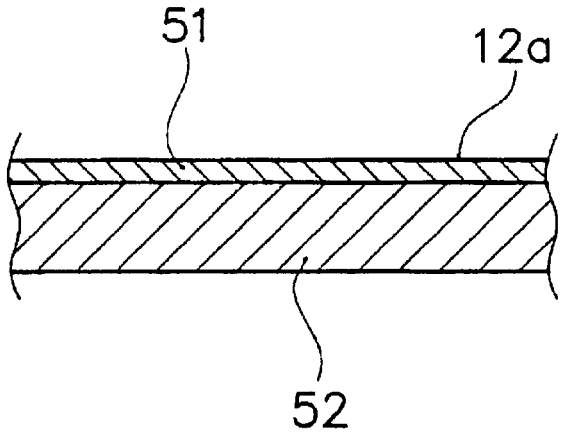
FIG. 11 is a partial cross-sectional view of the outer wall of a pocket of the vest incorporating buoyant material shown in FIG. 7.

As shown in FIG. 11, a plate-shaped foam piece 52 having a covering sheet 51 laminated onto the outer surface thereof is used as the plate-shaped member or outer wall 12*a* for each of the pockets 12. The plate-shaped foam piece 52 is preferably a synthetic resin foam piece comprising urethane or EVA (ethylene-vinyl acetate copolymer), and synthetic resin film, woven fabric or the like can be used for the covering sheet 51. It is particularly preferred that a waterproof film such as polyvinyl chloride film, EVA film or polyurethane film be used as the covering sheet 51. The curved configuration of the outer wall 12*a* and the configuration of the carrying concavities 50 are preferably created through hot pressing of the plate-shaped foam piece 52 on which the covering sheet 51 is laminated, using a mold or other apparatus. The covering sheet 51 is preferably affixed prior to molding using an adhesive or the like or heat-sealed during molding. The covering sheet 51 can also be located on the inner surface as well, but the internal plate-shaped foam piece 52 can be effectively protected by having the covering sheet 51 on at least the outer surface. In addition, by forming the plate-shaped foam piece 52 in a prescribed configuration via hot pressing, manufacturing is made easier, complex three-dimensional shapes can be easily made, and the covering sheet 51 can be affixed to the plate-shaped foam piece 52 simultaneously with the manufacturing thereof. While the outer walls 12*a* are particularly prone to contamination with dirt or other foreign matter when it protrudes outward, as opposed to when it is flat, not only does the use of a waterproof film as the covering sheet 51 minimize such contamination, but the dirt or other foreign matter that does adhere to the film can be easily wiped off. In this case, because the outer-walls 12*a* have a shape-retaining property, it is quite easy to wipe clean.

The pockets 12 in this embodiment as well are formed in an essentially square configuration as seen from the front in order to match the configuration of the concavities 17 in the buoyant material sections 4. However, in this embodiment, unlike in the embodiment shown in FIG. 1, a U-shaped opening is formed by the three sides other than the bottom edge of the pockets 12 as shown in FIG. 7. This opening can be freely opened and closed using the slide fasteners 14. While the outer walls 12*a* are curved so as to protrude outward as described above, the edges of the outer walls 12*a* are essentially flush with the outer surfaces 2*a* of the front portions 2, such that the thicknesses of the outer walls 12*a* will essentially match the amount of outward bulging of the pockets 12. In other words, the outer walls 12*a* are directly mounted to the front fabric pieces 8 of the front portions 2 via the slide fasteners 14. Because the amount of curvature of each outer wall 12*a* is basically identical to the amount of bulging of the pockets 12, there is very little bulging. Moreover, the curved shapes of the outer walls 12*a* allow the interior spaces of the outer walls 12*a* to be effectively used as the carrying spaces V of the pockets 12. In other words, the carrying spaces V of the pockets 12 comprise the space created by the concavities 17 together with the spaces created by the curvature of the outer walls 12*a*.

Moreover, because the outer walls 12*a* of the pockets 12 have shape-retaining properties, the size of each of the carrying spaces V of the pockets 12 is essentially fixed regardless of the existence of carried items. In addition, due to the shape-retaining properties of the outer walls 12*a*, the pockets 12 have an attractive external appearance even where no carried items reside therein, and when carried items are located in the pockets 12, the items can be protected from impact from the fronts of the pockets 12. The carried items are protected largely due to the fact that the concavities 17 are formed in the buoyant material sections 4 and most of the carrying spaces V of the pockets 12 reside in these concavities V. In other words, in the conventional art, because the pocket protrudes substantially outward, it can easily be subjected to external impact. Conversely, the construction in which the carrying spaces V of the pockets 12 are formed inside the concavities 17 formed in the buoyant material sections 4 offer the benefits that (i) there is little chance of impact since the amount of bulging of each pocket 12 itself is small, and (ii) the carried items are also protected by the buoyant material section 4 itself. In addition, if each of the outer walls 12*a* comprises a plate-shaped member having a shape-retaining property, the carried items can be protected in essentially all directions by the buoyant material section 4 and the outer wall 12*a*.

In particular, where the plate-shaped foam pieces 52 are used as the outer walls 12*a* as described above, the buffering effect provides further protection of the carried items. Moreover, because the outer surface is curved so as to protrude outward, especially where it is formed in a dome-like shape, it offers far more impact-resistance than a flat outer surface.

Incidentally, the outer walls 12*a* of the pockets 12 can be opened and closed by moving it upward and downward using the bottom edges 12*b* as a hinge-type fulcrum by opening the top and sides of the pockets 12 via the slide fasteners 14. A construction that allows the pockets 12 to be opened and closed using the bottom edges 12*b* as a hinge-type fulcrum allows it to be opened widely, thereby making it easy to place and remove carried items into and from the pockets 12. Because the outer walls 12*a* have shape-retaining properties, the opening and closing operations can be carried out easily.

Furthermore, the pockets 11 and 12 of this second embodiment (FIGS. 7–10) include a pair of gussets 53 in each of the pockets 11 and 12, as shown in FIG. 9. The gussets 53 of each of the pockets 11 and 12 acts a holding member that holds the outer walls 12*a* of the pockets 12 open at a prescribed angle. Thus, when the pockets 12 is in an open state, the outer walls 12*a* does not flop down. The gussets 53 not only prevent the outer walls 12*a* from flopping down via the holding member, but also prevent the carried items from falling out. In this embodiment, the gussets 53 connect both edges of the outer walls 12*a* of the pockets 12 to the pocket linings 15 at prescribed heights, as shown in FIG. 9. These gussets 53 make it easy to open and close the pockets 12. The opening angle can be set to various angles, but it is preferred that it be set such that the outer walls 12*a* becomes more or less horizontal, as shown by the chain double-dashed line in FIG. 8. Because the outer walls 12*a* have shape-retaining properties, a good horizontal surface is obtained. Moreover, when the outer walls 12*a* are maintained in essentially horizontal positions, the shape-retaining outer walls 12*a* can be used as a place to hold small items or as a work platform. Furthermore, while connecting straps or the like can be used in place of the gussets 53, by using connecting fabric pieces (including net-type fabric pieces) such as the gussets 53, the carried items can be prevented from falling out of the sides of the pockets. In addition, when the outer walls 12*a* are open, carried items that are placed on the inner surfaces of the outer walls 12*a* are effectively prevented from falling out because the outer walls 12*a* are curved so as to protrude outward and the inner surfaces are concave.

While pocket linings 15 are placed in the concavities 17 in the buoyant material sections 4 as shown in FIGS. 8 and 9, it is also acceptable to omit the pocket linings 15. In other words, a construction can be used in which the wall surfaces of the concavities 17 in the buoyant material sections 4 comprise the inner walls of the pockets 12. Each of the buoyant material sections 4 generally comprises a piece of synthetic resin foam, and when the pocket lining 15 is omitted, it is preferred that the surface of the synthetic resin foam piece be covered with a covering sheet such as jersey or waterproof film that is affixed thereto. For the waterproof film, various types of film including polyvinyl chloride film can be used, but it is particularly preferred that a film capable of being heat-sealed onto a synthetic resin foam piece, such as polyurethane film, be used.

It is also acceptable if the pockets 12 can be freely attached to and detached from the vest (clothing). For example, as shown in the third embodiment of FIG. 12, the pockets 12 can be fixed such that most of it resides inside the concavities 17 in the buoyant material sections 4, and such that it can be detached and made a stand-alone portable item. Alternatively, a plurality of identically-configured pockets 12 can be prepared beforehand, such that only the pockets 12 corresponding to the desired use can be selected and attached to the vest or clothing.

In a construction in which the pocket 12 can be freely attached and detached, a hook and loop fastener 55 (Velcro®), snap button or the like can be used as the fixing member. It is preferred that the fixing member be located inside the concavities 17. Locating the fixing members inside the concavities 17 offers the advantage that the fixing members do not pose an obstacle to the wearer when the pockets 12 are detached. Furthermore, the use of the hook and loop fastener 55 as the fixing member makes the pockets 12 particularly easy to attach and detach, and it is particularly preferred that either the hook part or the loop part be located on the pocket 12, while the other is located in the concavity 17, enabling the pocket 12 to be firmly attached via the single simple action of inserting it inside the concavity 17. Moreover, if the other part of the hook and loop fastener 55 is located not on a side wall of the concavity 17 but rather at the bottom of the concavity 17, as shown in FIG. 12, the direction of engagement of the hook part and the loop part matches the direction of insertion of the pocket 12 in the concavity 17, making it even easier to attach the pocket 12.

When the hook and loop fastener 55 is used, dirt or other foreign matter can easily adhere to the hook part. Thus, it is considered preferable to mount the loop part on the pocket 12, which is often detached from the vest and carried separately. Conversely, the hook part is mounted on the vest, and by locating the hook part inside the concavity 17, because the hook part is located away from the outer surface of the vest, the adherence of dirt or other foreign matter to the hook part can be minimized. It is particularly preferred that the hook part be located at the bottom of the concavity, which is the area farthest from the outside of the vest, as shown in FIG. 12.

Figure 12:
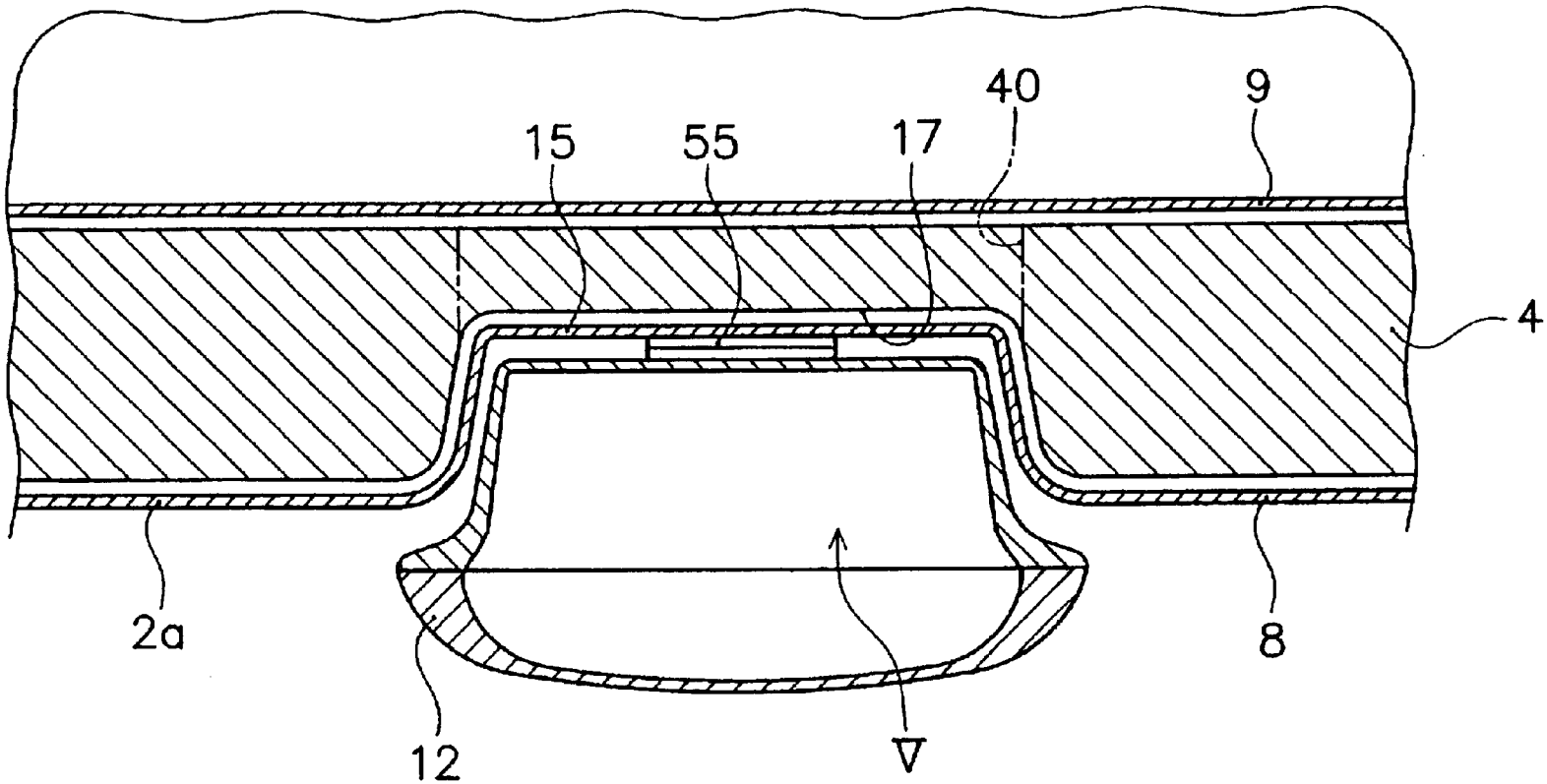
FIG. 12 is a partial cross sectional view, corresponding to FIG. 9, of a vest incorporating buoyant material in accordance with another embodiment of the present invention showing the important parts of the vest that differs from the vest shown in FIG. 7.

In FIG. 12, the front fabric pieces 8 of the front portions 2 are sewn on such that they reside inside the concavities 17 in the buoyant material sections 4, and the hook parts of the hook and loop fasteners 55 are sewn onto the front fabric pieces 8 located in the concavities 17. It is also acceptable to omit the front fabric piece 8 and to attach the pocket 12 directly to the surface of the buoyant material section 4. Furthermore, the pocket 12 can be made of cloth or of a plate-shaped member having a shape-retaining property. Alternatively, the pocket 12 can be formed via injection molding. Even where the pocket 12 has a detachable construction as described above, because the pocket 12 is attached to the vest by placing it inside the concavity 17, the amount of bulging of the pocket 12 can be reduced in comparison with the construction in which the part of the vest to which the pocket 12 is attached is flat.

Figure 13:
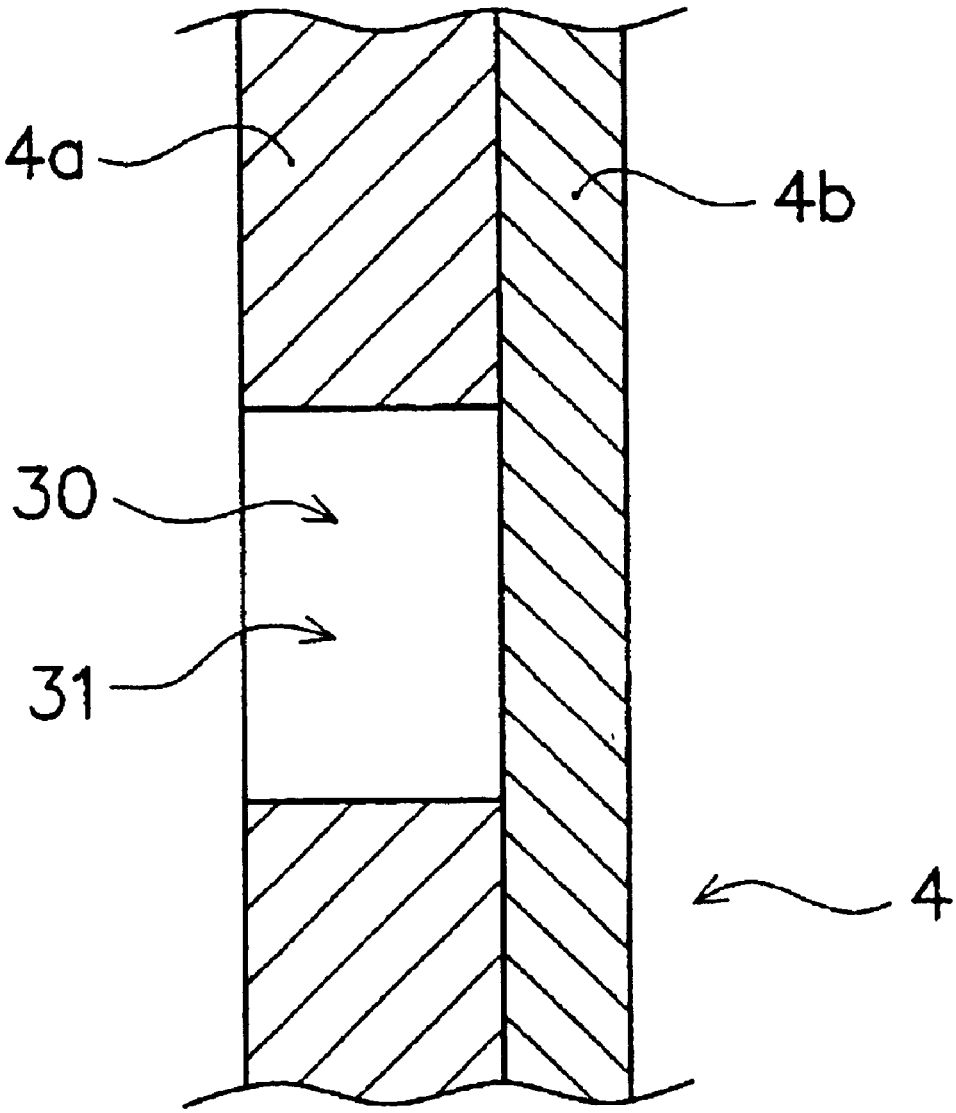
FIG. 13 is a partial cross-sectional view of the important parts of the buoyant material section used in a vest incorporating buoyant material in accordance with another embodiment of the present invention.

Concavities can be formed in the buoyant material section using a method in which the buoyant material section is hot-pressed using a mold or the like, for example, or the following method can be used. In this method, each of the buoyant material sections 4 comprises a front layer 4*a* and a back layer 4*b*, and several concavities 31 (only one shown) are formed in the outer surface of the buoyant material section 4 by forming several through holes 30 (only shown) in the front layer 4*a* and their affixing via gluing or other method the back layer 4*b* to the front layer 4*a* so as to close off the through holes 30, as shown in FIG. 13. Conversely, when the concavities 31 are located on the inner surface, the through holes 30 are formed in the back layer 4*b*.

In the above embodiments, the concavities were formed on either the inner surface or outer surface of the buoyant material section, but it is also acceptable if through holes 40 that pierce both the inner and outer surfaces are formed at positions corresponding to the pockets, as indicated by the chain double-dashed lines in FIGS. 4, 6, 8, 9 and 12, and the carrying spaces V are formed in these through holes 40. In this case as well, the amount of bulging is minimized, making movement easy. Where through holes 40 are used, pockets can be formed at identical locations on the outside and the inside of the buoyant material section, and the carrying spaces for those pockets can be formed inside the same through hole 40.

While the example of a flotation vest was used above, the present invention can be applied in various types of clothing incorporating buoyant material, such as clothing having sleeves or clothing that combines a top and bottom, and the locations of the buoyant material sections can be changed as appropriate in accordance with the design. Furthermore, while a construction in which the buoyant material was incorporated into the clothing was described above, a construction in which the buoyant material is mounted directly to the outer or inner surface of the clothing also falls within the intended scope of the present invention.

Because concavities or through holes are formed at positions corresponding to pockets and at least a part of the carrying space of the pockets is formed in the concavities or through holes, the amount of bulging of the pockets can be reduced relative to the conventional art, and a fisherman or other wearer can move his or her arms more freely.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application Nos. 2001-246756 and 2002-077007. The entire disclosures of both of Japanese Patent Application Nos. 2001-246756 and 2002-077007 are hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An article of clothing comprising:

a main clothing unit having at least one pocket located at a prescribed position; and a buoyant material coupled to the main clothing unit, the buoyant material having at least one concavity formed within the buoyant material and formed at a position that corresponds to the pocket such that a majority of a carrying space of the pocket is formed inside the concavity; and wherein the main clothing unit includes a front portion and a back portion coupled to the front portion to form a vest; and the buoyant material includes a front buoyant material section located in the front portion and a rear buoyant material section located in the back portion, with the concavity being formed in one of inside and outside facing surfaces of one of the front and rear buoyant material sections that corresponds to the prescribed position of the pocket.

2. The article of clothing according to claim 1, wherein the main clothing unit includes an additional pocket with an additional carrying space located at an additional prescribed position, and the buoyant material includes an additional concavity formed in one of inside and outside facing surfaces of one of the front and rear buoyant material sections at a position that corresponds to the additional prescribed position of the additional pocket such that at least a part of the additional carrying space of the additional pocket is formed inside the additional concavities.

3. An article of clothing comprising:

a main clothing unit having at least one pocket located at a prescribed position; and a buoyant material coupled to the main clothing unit, the buoyant material having at least one concavity formed within the buoyant material and formed at a position that corresponds to the pocket such that a majority of a carrying space of the pocket is formed inside the concavity; and wherein the pocket has an outer wall that is a plate-shaped member with a shape-retaining property.

4. The article of clothing according to claim 3, wherein the outer wall of the pocket is formed such that an outer surface of the outer wall protrudes outward relative to the main clothing unit.

5. The article of clothing according to claim 4, wherein the outer wall of the pocket has a dome configuration.

6. The article of clothing according to claim 3, wherein the plate-shaped member comprises a plate-shaped foam piece having a covering sheet laminated onto at least an outer surface of the plate-shaped foam piece.

7. The article of clothing according to claim 6, wherein the outer wall of the pocket is formed by hot press shaping of the plate-shaped foam piece such that the outer surface of the plate-shaped foam piece protrudes outward.

8. The article of clothing according to claim 6, wherein the covering sheet comprises a waterproof film.

9. The article of clothing according to claim 3, wherein the outer wall of the pocket is configured to open and close using a bottom edge of the pocket as a hinge-type fulcrum.

10. The article of clothing according to claim 9, wherein the main clothing unit includes a holding member configured to hold the outer wall of the pocket open at a prescribed angle when the pocket is in an open state.

11. The article of clothing according to claim 10, wherein the holding member is configured to hold the outer wall of the pocket such that it assumes a substantially horizontal orientation relative to the concavity.

12. The article of clothing according to claim 3, wherein the outer wall of the pocket includes a small pocket that is formed on an inner surface of the outer wall by sewing a fabric piece onto the inner surface of the outer wall.

13. The article of clothing according to claim 12, wherein the inner surface of the outer wall of the pocket includes a carrying concavity located opposite the small pocket.

14. The article of clothing according to claim 13, wherein the inner surface of the outer wall of the pocket includes additional carrying concavities that form independent pockets with the fabric piece.

15. The article of clothing according to claim 14, wherein the fabric piece is a stretch fabric arranged to press items housed in the independent pockets against the inner surface of the outer wall due to elastic characteristics of the stretch fabric.

16. The article of clothing according to claim 12, wherein the fabric piece is a stretch fabric arranged to press items housed in the small pocket against the inner surface of the outer wall due to elastic characteristics of the stretch fabric.

17. The article of clothing according to claim 3, wherein the concavity in the buoyant material forms an inner wall of the pocket.

18. The article of clothing according to claim 3, wherein the pocket is detachable from a remaining portion of the main clothing unit.

19. The article of clothing according to claim 18, wherein a fixing member is located inside the concavity of the buoyant material to fix the pocket to the main clothing unit.

20. The article of clothing according to claim 19, wherein the fixing member is a hook and loop fastener having a hook part and a loop part with one of the hook and loop parts being located on the pocket while the other is located inside the concavity.

21. The article of clothing according to claim 20, wherein the loop part of the hook and loop fastener is located on the pocket, while the hook part of the hook and loop fastener is located on a remaining portion of the main clothing unit.

22. The article of clothing according to claim 21, wherein the hook part is located at a bottom section of the concavity.

23. An article of clothing comprising:

a main clothing unit having at least one pocket located at a prescribed position; and a buoyant material coupled to the main clothing unit, the buoyant material having at least one concavity formed within the buoyant material and formed at a position that corresponds to the pocket such that a majority of a carrying space of the pocket is formed inside the concavity;

the main clothing unit includes additional pockets with additional carrying spaces, and the buoyant material includes additional concavities formed at positions on at least one of inside and outside facing surfaces of the buoyant material that correspond to the additional pockets such that at least one part of the additional carrying spaces of the additional pockets is formed inside one of the additional concavities, wherein the main clothing unit includes a front portion and a back portion coupled to the front portion to form a vest; and the buoyant material includes a front buoyant material section located in the front portion of the vest and a back buoyant material section located in the back portion.

24. An article of clothing comprising:

a main clothing unit having at least one pocket located at a prescribed position, the at least one pocket having an outer wall that is a plate-shaped member with a shape-retaining property, the plate-shaped member comprising a plate-shaped foam piece having a covering sheet laminated onto at least an outer surface of the plate-shaped foam piece; and a buoyant material coupled to the main clothing unit, the buoyant material having at least one concavity formed at a position that corresponds to the pocket such that at least a part of a carrying space of the pocket is formed inside the concavity.

25. The article of clothing according to claim 24, wherein the outer wall of the pocket is formed by hot press shaping of the plate-shaped foam piece such that the outer surface of the plate-shaped foam piece protrudes outward.

26. The article of clothing according to claim 24, wherein the covering sheet comprises a waterproof film.

27. An article of clothing comprising:

a main clothing unit having at least one pocket located at a prescribed position, the at least one pocket having an outer wall that is a plate-shaped member with a shape-retaining property, the outer wall of the pocket being configured to open and close using a bottom edge of the pocket as a hinge-type fulcrum, the main clothing unit including a holding member configured to hold the outer wall of the pocket open at a prescribed angle when the pocket is in an open state; and a buoyant material coupled to the main clothing unit, the buoyant material having at least one concavity formed at a position that corresponds to the pocket such that at least a part of a carrying space of the pocket is formed inside the concavity.

28. The article of clothing according to claim 27, wherein the holding member is configured to hold the outer wall of the pocket such that it assumes a substantially horizontal orientation relative to the concavity.

29. An article of clothing comprising:

a main clothing unit having at least one pocket located at a prescribed position, the at least one pocket having an outer wall that is a plate-shaped member with a shape-retaining property, the outer wall of the pocket including a small pocket that is formed on an inner surface of the outer wall by sewing a fabric piece onto the inner surface of the outer wall, the inner surface of the outer wall of the pocket includes a carrying concavity located opposite the small pocket; and a buoyant material coupled to the main clothing unit, the buoyant material having at least one concavity formed at a position that corresponds to the pocket such that at least a part of a carrying space of the pocket is formed inside the concavity.

30. The article of clothing according to claim 29, wherein the inner surface of the outer wall of the pocket includes additional carrying concavities that form independent pockets with the fabric piece.

31. The article of clothing according to claim 30, wherein the fabric piece is a stretch fabric arranged to press items housed in the independent pockets against the inner surface of the outer wall due to elastic characteristics of the stretch fabric.

32. An article of clothing comprising:

a main clothing unit having at least one pocket located at a prescribed position, the at least one pocket having an outer wall that is a plate-shaped member with a shape-retaining property, the outer wall of the pocket including a small pocket that is formed on an inner surface of the outer wall by sewing a fabric piece onto the inner surface of the outer wall, the fabric piece being a stretch fabric arranged to press items housed in the small pocket against the inner surface of the outer wall due to elastic characteristics of the stretch fabric; and a buoyant material coupled to the main clothing unit, the buoyant material having at least one concavity formed at a position that corresponds to the pocket such that at least a part of a carrying space of the pocket is formed inside the concavity.

* * * * *